United States Patent [19]

Suyama

[11] 4,122,914

[45] Oct. 31, 1978

[54] MUFFLER

[75] Inventor: Eizo Suyama, Mitaka, Japan

[73] Assignee: Nihon Radiator Co., Ltd., Tokyo, Japan

[21] Appl. No.: 789,917

[22] Filed: Apr. 22, 1977

[30] Foreign Application Priority Data

| | | | |
|---|---|---|---|
| Apr. 30, 1976 | [JP] | Japan | 51-53200[U] |
| Apr. 30, 1976 | [JP] | Japan | 51-53201[U] |
| Aug. 31, 1976 | [JP] | Japan | 51-115747[U] |
| Aug. 31, 1976 | [JP] | Japan | 51-115748[U] |

[51] Int. Cl.[2] ..... F01N 3/06

[52] U.S. Cl. ..... 181/258; 181/265; 181/272

[58] Field of Search ..... 181/265, 272, 275, 258, 181/249, 252, 269

[56] References Cited

U.S. PATENT DOCUMENTS

| | | | |
|---|---|---|---|
| 1,666,257 | 4/1928 | Furnivall | 181/258 |
| 3,754,620 | 8/1973 | Foster | 181/265 |
| 4,056,934 | 11/1977 | Mizusawa | 181/265 X |

*Primary Examiner*—Donald G. Kelly

*Attorney, Agent, or Firm*—Blum, Moscovitz, Friedman & Kaplan

[57] ABSTRACT

Mufflers suitable for use with automobile engines include a main body closed at the forward and rear ends thereof by forward and rear end plates, an inlet pipe leading into the main body through an aperture in the forward end plate and an outlet pipe leading out of the main body through the rear end plate. Features in accordance with the present invention contributing to muffling of engine sound are a flared end on the upstream end of the outlet pipe, a porous covering of heat-resistant material over the downstream end of the inlet pipe, short-circuit holes in at least one of the pipes, a porous partition separating the interior of the main body into forward and rear chambers, and selected ratios of the lengths of the portions of the inlet and outlet pipes within the main body.

23 Claims, 13 Drawing Figures

MUFFLER

BACKGROUND OF THE INVENTION

The present invention relates to a muffler for use with an engine of an automobile and the like, and more particularly to a muffler of the expansion type, through which engine exhaust gas is passed to damp noise included therein.

Heretofore, a muffler of the expansion type has been used, in which engine exhaust gas is repeatedly expanded and contracted to damp its pulsating noise.

However, not only in the case of this expansion type muffler, but also in the general case, when an outlet pipe is provided for flow of exhaust gas therethrough in contracted state, usually the end of pipe has been cut at right angles to the axis of pipe which increases flow resistance thus increasing back pressure. In addition, Karman's vortex street to cause secondary noise of gas flow, and the like may be generated.

Further, in the usual muffler of the expansion type, there are the disadvantages that when the exhaust gas flows from an inlet pipe into the muffler, the uniform velocity core of the jet which is produced (jet-like portion conically converging as the gas flow leaves the inlet pipe, and having a length which is about five times the diameter of inlet pipe) strikes against the rear end plate of the muffler body and rebounds therefrom to generate a large quantity of noise. Also, when the exhaust gas flows into and expands within the muffler main body, Karman's vortex street and turbulence will occur to cause secondary noise.

The usual muffler of the expansion type has the further disadvantage that except during normal running of the engine, strange noise is produced at the time of quick acceleration and quick deceleration, and even though this disadvantage is eliminated, strange noise maybe produced depending upon the position of the mounting of the engine, as well as for other reasons.

In the usual muffler of the expansion type, when a throttled portion, i.e., a transition from a larger to a smaller diameter is formed at the open end of the exhaust gas inlet pipe, the pressure pulsation of exhaust gas is roughly rectified. However there is fatal drawback for such a muffler in that secondary noise of gas flow will occur as will be described below; such noise must be eliminated.

The muffler according to this invention is made to eliminate above mentioned disadvantages.

SUMMARY OF THE INVENTION

A muffler of the expansion type in accordance with the present invention comprises a main body including a housing which may be cylindrical or roughly elliptical in shape, said housing being closed at the front and rear thereof by front and rear end plates respectively. Said housing and said plates define a chamber. An inlet pipe enters said chamber through an aperture in said front end wall and an outlet pipe leads out of said chamber through an aperture in said rear end wall. To muffle a sound of exhaust gas entering said main body through said inlet pipe and leaving said main body through said outlet pipe, said inlet pipe may be throttled, that is, may have a smaller diameter at the downstream end thereof within said main body. Further, the upstream end of said inlet tube within said main body may have apertures therein, termed "short-circuit holes" through which part of the exhaust gas may flow into said main body. Further, the upstream end of said outlet pipe within said main body may be flared outwardly so that it is trumpet-shaped.

In a preferred embodiment, the downstream end of said inlet pipe may be capped or otherwise covered with a disc of heat-resistant porous material permitting the passage of gas therethrough, said disc being of construction such that the path of gas traversing same is substantially longer than the thickness of said disc. Said disc may be held in annular constrictions or a constriction and a flange proximate the end of said inlet pipe.

In a further embodiment, one or more partitions are disposed in said main chamber for dividing same into two or more subchambers. Said partition is porous, and where one partition is present, dividing said chamber into an upstream, or front chamber and a downstream, or back chamber, said inlet pipe penetrates through said partition to discharge exhaust gas into said upstream chamber and said exhaust pipe penetrates said partition so that exhaust gas which has diffused through said partition enters said exhaust pipe from said downstream chamber. Short circuit holes may be present in said inlet pipe so that exhaust gas enters said downstream chamber without penetrating said partition. Similarly, exhaust holes may be present in said outlet pipe so that exhaust gas enters said exhaust pipe directly from said upstream chamber.

In yet another embodiment a porous diffuser may be placed over the downstream end of said inlet pipe, said downstream end being constricted.

In yet a further embodiment, said downstream end is constricted to form a jet, and a barrier is positioned at a distance which exceeds five times the diameter of said downstream end.

Accordingly, it is an object of this invention to provide a muffler, wherein the upstream end of an outlet pipe, into which the contracted exhaust gas flows, is continuously expanded in diameter in the opposite direction to the flow of exhaust gas to minimize the loss of contracted flow thereof, as well as to suppress the occurrence of Karman's vortex street to reduce secondary noise of air flow.

It is another object of this invention to provide a muffler, wherein the flow of exhaust gas pulsatingly exhausted from the engine is smoothed to reduce the noise of exhaust gas, as well as to bring about an effective muffling characteristic with simple construction.

It is a further object of this invention to provide a muffler, wherein the exhaust gas from the engine is subjected to the action of throttling, expansion, resistance and interference to sufficiently damp the noise pressure of exhaust gas to bring about a constant muffling effect.

It is still another object of this invention to provide a muffler, wherein the occurrence of secondary noise of gas flow due to a jetting core formed by the throttled end of an inlet pipe for exhaust gas is positively prevented with simple construction.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
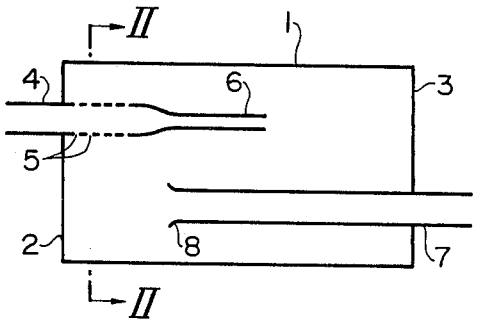
FIG. 1 is an axial sectional view showing an embodiment of a muffler of the expansion type according to this invention.
Figure 2:
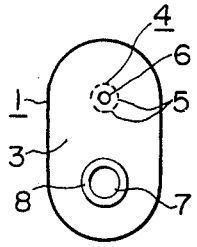
FIG. 2 is a sectional view taken along II—II line of FIG. 1.
Figure 3:
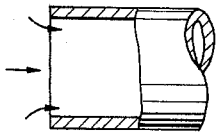
FIG. 3 is a partly sectional view of the pipe end of the exhaust gas contracted flow portion of a conventional straight pipe system.

In FIG. 1 and FIG. 2, there is shown an embodiment, wherein the downstream portion of an inlet pipe within a muffler body is reduced in diameter to reduce the loss of contracted flow of exhaust gas, as to suppress well as the occurrence of Karman's vortex street in order to reduce secondary noise of air flow. In the usual construction, as shown in FIG. 3, the pipe end is cut at right angles with the axis of pipe, so that there are the disadvantages that the resistance of produced by contracting the flow of exhaust gas is large, resulting in remarkable large loss of contracted flow, and that Karman's vortex street will occur within the pipe near the inlet port thus causing secondary noise of gas flow and the like.

In FIG. 1 and FIG. 2, 1 is a sealed cylindrical main body having a front end plate 2 and a rear or back end plate 3, 4 is an inlet pipe inserted into the main body 1 through the front end plate 2 up to the ½ the length of the inside of the main body. At the base or upstream portion of the pipe, within the main body, short-circuit holes 5 are provided, and tip or downstream portion of the pipe is throttled to make a reduced diameter portion 6. Outlet pipe 7 is inserted into the main body 1 through the back end plate 3 for a distance up to the 3/4 the length of the body, and the outlet pipe end within the main body is continuously expanded in trumpet-like shape to form an expanded open portion 8.

With such a construction, the exhaust gas flowing through the inlet pipe 4 will be contracted as it enters the reduced diameter portion 6 and will jet from the open tip into the main body 1 where it will expand. Then this exhaust gas is contracted again as it flows into the outlet pipe 7. At this time, the exhaust gas is guided by the expanded open portion 8 to be contracted smoothly, so that the flow-in resistance will be small and the loss of contracted flow will be small compared with usual type in which the gas flow is suddenly contracted, and because of continuous and smooth throttling of flow path, Karman's vortex street will not occur so these will be no secondary noise.

In this embodiment, a part of exhaust gas within the inlet pipe 4 flows directly into the main body 1 from the short-circuit holes 5 to minimize the increase of exhaust gas pressure due to the presence of the reduced diameter portion 6, thus also minimizing the increase of engine back pressure.

The shape of the expanded opening portion 8 in longitudinal section, which is formed by continuous expansion in diameter of the inlet or upstream end of the outlet pipe 7, will have a large effect when the shape is made as a curve of higher degree such as an involute curve. In the embodiments of FIGS. 1 and 2, a single inlet pipe 4 and a single outlet pipe 7 are provided, but a muffler having another intermediate pipe for passing the exhaust gas from one to the other may be effectively used by forming an expanded opening portion on its inflow end for exhaust gas. Also, the shape of the expanded open portion 8 will be determined in compliance with the object of muffling as to quantity, temperature, frequency of pulsation of exhaust gas and type of engine and the like.

Since the muffler of this embodiment is constructed as above mentioned, it has large practical effect that the contracted inflow of exhaust gas at the open pipe end is smoothly performed and muffling may be done without the increase of the loss of contracted flow and without causing secondary noise contrary to the usual case. Also, its construction is simple and its production is easy, because it may be constructed by expanding the diameter of pipe end in compliance with the object of muffling.

Figure 4:
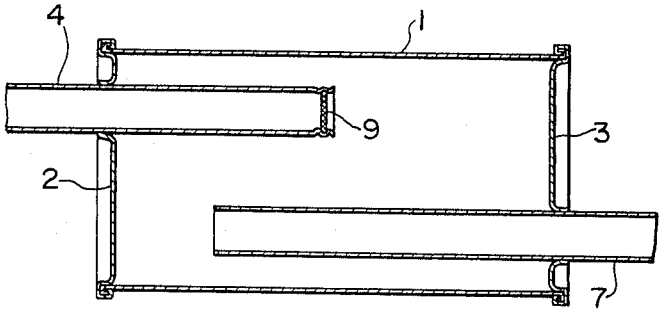
FIG. 4 is an axial sectional view showing another embodiment of a muffler according to the present invention.
Figure 5:
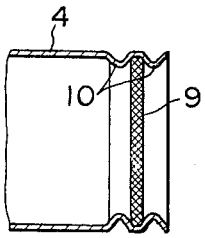
FIG. 5 and FIG. 6 are enlarged partial sectional views showing examples of constructions for holding a porous member in the embodiment of FIG. 4.
Figure 6:
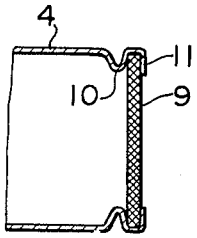
Figure 7:
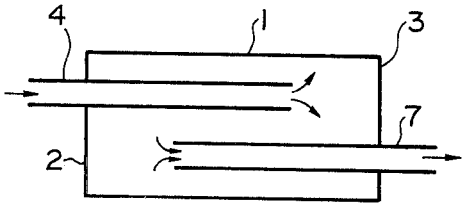
FIG. 7 PRIOR ART
FIG. 7 is a schematic view of the construction of a conventional muffler of the expansion type.

In FIGS. 4 to FIG. 6, there is shown another embodiment of a muffler according to the present invention. In this embodiment, exhaust gas flow pulsatingly exhausted from the engine is smoothed to decrease the noise of exhaust gas. In the usual muffler, as shown in FIG. 7, the exhaust gas flows into the main body 1 from the inlet pipe 4 and the flow path is expanded at this point; the exhaust gas then moves backward, and when it flows into the outlet pipe 7, the flow path is contracted. The internal energy of the gas is lost by the interference of sound wave and the like and pulsation is suppressed muffling the sound. However, in a muffler of such a construction, there are disadvantages that when the exhaust gas flows into the main body 1 from the inlet pipe 4, the uniform velocity core of the resultant jet (jet-like portion conically converging as the gas flow leaves the inlet pipe 4, the length of said jet-like portion being about five times the diameter of the inlet pipe) strikes against the back end plate 3 and rebounds therefrom to generate high-intensity sound and when the exhaust gas flows into and expands within the main body 1, Karman's vortex street and turbulence will occur to cause secondary noise.

The muffler of this embodiment is made to eliminate such disadvantages.

As shown in FIG. 4, both ends of the main body 1 are closed by means of front end plate 2 and back end plate 3 respectively, and an inlet pipe 4 is inserted through the front end plate 2 and an outlet pipe 7 through the back end plate 3 respectively. The muffler according to this embodiment is characterized in that a disc-shaped continuous porous member 9 made of heat resistant material is provided at the downstream end portion of the inlet pipe 4 within the main body 1; said porous member 9 providing circuitous gas flow paths therethrough and being formed of materials such as spongy metal, metallic wool mat, multilayer netting made of piled wire nettings and the like.

FIG. 5 and FIG. 6 show examples of a continuous porous member 9 attached to the end portion of the inlet pipe 4, wherein FIG. 5 is an example showing that annular constricted portions 10, 10 are formed within the cross section of said pipe 4 to secure said porous member 9 between said portions 10, 10, and FIG. 6 is another example showing that said porous member 9 is secured between a similar constricted portion 10 and an internally-directed flange portion 11 formed on the downstream end portion of said pipe 4.

In this manner, the continuous porous member 9 is attached to the open end portion of the inlet pipe 4 within the main body 1, so that when the exhaust gas flows into the main body 1 from the inlet pipe 4, the uniform velocity core of jet is broken by said poroud member 9, thus the development of secondary noise, Karman's vortex street and turbulence may be prevented and an effective muffler of small type may be obtained.

Figure 8:
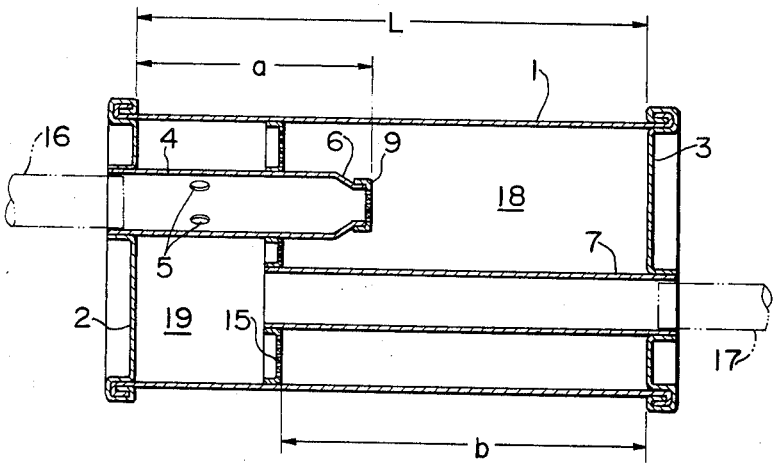
FIG. 8 is an axial sectional view showing still another embodiment of a muffler according to the present invention.

In FIG. 8, still another embodiment of a muffler according to the present invention is shown. The muffler of this embodiment aims at obtaining good muffling effect by mutual action among a heat-resistant continuous porous member attached to the open end portion of the exhaust gas inlet pipe within the muffler main body, short-circuit holes provided on either the inlet pipe or the outlet pipe, and a porous partition wall. In this embodiment, both ends of a cylindrical muffler main body 1 are closed by end plates 2, 3, an inlet pipe 4 and an outlet pipe 7 are inserted into the main body through the end plates, both pipes 4 and 7 are supported by a porous partition wall 15, and the tip of the inlet pipe 4 is throttled to form a reduced diameter portion 6, to which a cap-shaped heat-resistant continuous porous member 9 is attached, and short-circuit holes 5 are provided on side walls of said pipe 4.

The ratios of the length $a$ of inlet pipe 4 within the main body and the length $b$ of outlet pipe 7 within the main body to that of the main body may be:

$a = \frac{1}{2}L$ and $b = \frac{3}{4}L$ or $a = \frac{3}{4}L$ and $b = \frac{1}{2}L$, where, L is the length of the main body 1.

And, the diameter $\phi$ and number of the short-circuit holes 5 may range from 2 mm ® × 4 to 6 mm $\phi \times 2$, where the diameter of inlet pipe is 40 mm, the sizes being selected to provide equivalent areas for other diameter pipes.

When exhaust pipes 16, 17 are connected to the inlet pipe 4 and the outlet pipe 7 respectively and engine exhaust gas is passed from said exhaust pipe 16 into the main body 1 through the inlet pipe 4, the exhaust gas having pulsating pressure is throttled at the reduced diameter portion 6 of the tip of the inlet pipe 4 and dispersed into fine stream passing through gas holes of the continuous porous member 9 to be expanded as the gas enters a rear (upstream) chamber 18. The exhaust gas then traverses holes in the partition wall 15 into a front (downstream) chamber 19 of the main body 1, and enters the outlet pipe 7 leading to the exhaust pipe 17. A part of exhaust gas stream flowing through the inlet pipe 4 enters directly into the front (downstream) chamber 19 through the short-circuit holes 5, the purpose of this construction being to prevent rise of engine back pressure due to the resistance of the exhaust gas passing through the continuous porous member 9. The short-circuit holes also effect muffling by the interference between the muffling due to the expansion of exhaust gas in the front chamber 19 and the exhaust gas entering into the front chamber 19 after passing through the porous partition wall 15. The porous partition wall 15 is effective in damping jetting noise caused when the exhaust gas passes through the continuous porous member 9. As the heat resisting continuous porous member 9, foam metal sintered into the porous state by pressing fine grains of metal may be used.

Thus, the exhaust gas passes through the main body 1 and is subjected to each of the actions of throttling, flow resistance, expansion contraction and interference, and by determining the length of inlet pipe 4 and outlet pipe 7 relative to the length of the main body and the dimension of short-circuit holes 5 as described above, sound pressure may be fully damped to enhance the efficacy of the muffler.

The muffling effect depends upon positions on the exhaust gas pipe at which the muffler is attached, however, if the positions of short-circuit holes 5 are adjusted before and behind along the inlet pipe 4, substantial variation in the fitting position of muffler may be made (according to Japanese patent application No. 115615/1974) to enhance the muffling effect.

Figure 9:
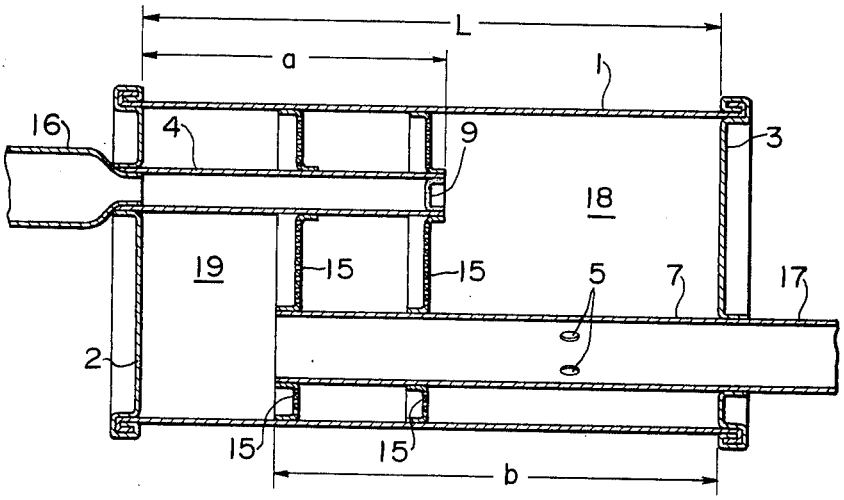
FIG. 9 is a sectional view showing a variation of the muffler of in FIG. 8.
Figure 10:
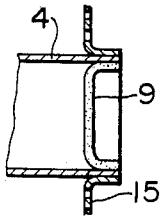
FIG. 10 is an enlarged view of the construction for holding the porous member of FIG. 9.

FIG. 9 shows a variation of the embodiment shown in FIG. 8, wherein the inlet pipe 4 has a smaller diameter than that of the exhaust gas pipe 16 the downstream end of pipe 4 having attached thereto a dish-shaped heat-resistant continuous porous member 9. In this embodiment two porous partition walls 15 are provided within the main body 1, and short-circuit holes 5 are provided in the outlet pipe 7.

The exhaust entering in from exhaust pipe 16 is subjected to throttling action due to the inlet pipe 4 having smaller diameter than exhaust pipe 16, resistance action due to the porous member 9, fine flow dispersion and jetting into the rear chamber 18 of the main body, removal of jetting noise due to the porous partition walls 15, 15, throttling due to the short-circuit holes 5, and interference action, as the result of which the noise of the exhaust gas is damped. The gas is exhausted from the exhaust pipe 17.

Substantial variation in the fitting position of the muffler may be made according to the positions of the short-circuit holes 5, as in the preceding embodiment.

As mentioned above, according to this embodiment, better muffling effect may be obtained with simple construction, so that the muffler is practical and effective.

Figure 11:
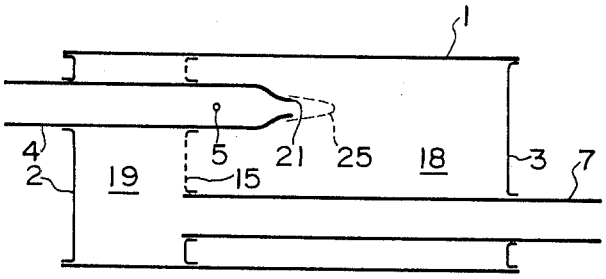
FIG. 11 is a sectional view showing a further embodiment of a muffler according to this invention.
Figure 12:
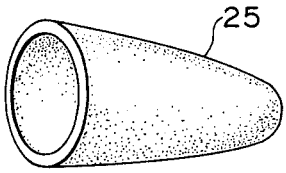
FIG. 12 is an enlarged perspective view of a cap member attached to the muffler shown in FIG. 11.

FIGS. 11 and 12 show another embodiment of the muffler in accordance with the present invention, wherein a throttled portion is formed at the open end of the exhaust gas inlet pipe 4 so that the generation of secondary noise in the gas flow is positively prevented by the simple construction of the muffler.

When the throttled portion is formed at the open end of the exhaust gas inlet pipe, it has the effect that the pulsation of the exhaust gas is roughly rectified in the pipe, but it has also a fatal disadvantage for a muffler in that secondary noise is generated in the flowing gas as described later. Therefore, such a noise must be eliminated.

Figure 13:
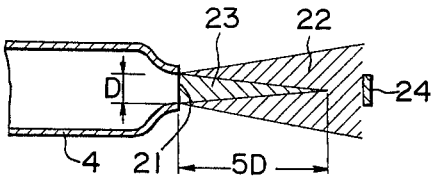
FIG. 13 is a sectional view showing a jetting velocity core of the exhaust gas formed at the throttled open end of the inlet pipe.

As shown in FIG. 13, when the exhaust gas is ejected from the throttled end 21 of a pipe 4, a core of jetting flow is formed, said core consisting of a divergent diffusing gas portion 22 and a central conical uniform-velocity core portion 23. The diffusing gas portion 22 of the core of the jetting gas flow except the uniform-velocity core 23 generates the secondary noise of the gas flow due to Karman's vortex street and the like. It is found that the secondary noise of the gas flow increases as an obstacle 24 having no gas permeability is brought toward the uniform-velocity core 23. The uniform-velocity core 23 shows the region in which the flow velocity of the exhaust gas in the pipe 4 is equal to the jetting gas flow velocity. Also the core 23 is formed in the shape of a core having a bottom surface coinciding with the open end of the pipe and having a height which is five times the diameter D of the open end. Heretofore, no effective method of eliminating this secondary noise of gas flow has been developed. Thus, the muffling effect of the prior art mufflers has been reduced by about half, even though the open end of the exhaust gas inlet pipe is throttled.

In the embodiment of the present invention, a cap member 25 in generally conical form made of a foam metal shown in FIG. 12 is placed on the throttled open end 21 of the exhaust gas inlet pipe 4, as shown in FIG. 11. The foam metal is a kind of heat-resistant continuous gas-permeable member and is made of metallic fibers and the like. The remaining portions of the muffler may be constructed in like manner to the embodiments mentioned previously. In the embodiment shown in FIG. 11, the numeral 1 designates the cylindrical body, 2, 3 the front and back end plates, 15 a porous baffle plate dividing the muffler into the rear upstream chamber 18 and the front downstream chamber 19, while 7 designates the exhaust gas outlet pipe passing through the rear chamber 18 and opening in the front chamber 19. The numeral 5 designates the short-circuit holes formed in the exhaust gas inlet pipe 4.

The pulsation in the exhaust gas flowing into the exhaust gas inlet pipe 4 is partially rectified in the inlet pipe 4, because the open end 21 is throttled. A portion of the exhaust gas flows directly into the rear chamber 18 through the short-circuit holes 5 so as to prevent the pressure in the inlet pipe 4 from being increased, while the major portion of the exhaust gas flows into the cap member 25 from the open end 21. Since the front portion of the open end 21 is covered by the cap member 25 which is made of gas-permeable continuous porous material, no jetting gas flow as shown in FIG. 13 is formed and, hence, no secondary noise is generated. Since the cap member 25 is in blind form, the exhaust gas introduced into the cap member undergoes further rectification producing a further muffling effect. The gas then passes through the continuous porous material of the cap member 25 causing repeated expansion and contraction of the flow path and bypass of the exhaust gas, so that the exhaust gas diffuses into the rear chamber 18 from the fine holes in the surface of the cap member 25 pulsations in the flowing gas being still further rectified by the cap member 25. desired muffling effect is obtained even when the height of the cap member 25 is either greater or smaller than 5D mentioned previously.

As mentioned above, in the present embodiment, the formation of the core of the jetting exhaust gas flow at the throttled open end of the inlet pipe can be suppressed, so that the exhaust gas is rectified and the generation of the secondary noise in the gas flow is completely prevented by virtue of the simple construction of the muffler, thereby enhancing the muffling effect of the throttle construction, porous partition and short-circuit holes.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Muffler of the expansion type comprising a sealed, essentially cylindrical main body, front and back end plates at each end of said main body, an exhaust gas inlet pipe entering said main body through said front end plate and having a downstream end, an exhaust gas outlet pipe leading out of said main body through said back end plate and having an upstream end within said main body, said upstream end being outwardly flared for reduction of contraction loss and of noise as exhaust gas enters said outlet pipe, and in particular for eliminating Karman's vortex street and the attendant noise thereof.

2. Muffler according to claim 1, wherein said outwardly-flared end on said exhaust gas outlet pipe has, in longitudinal section, the shape of an involute curve.

3. Muffler according to claim 1, wherein the tip portion downstream of said inlet pipe is of reduced diameter.

4. Muffler according to claim 3, wherein said inlet pipe has a base portion between said front wall and said tip portion and the wall of said base portion of said exhaust gas inlet pipe is provided with short-circuit holes.

5. Muffler according to claim 4, wherein the length of said inlet pipe within said main body is up to half the length of said main body and the length of said outlet pipe within said main body is up to $\frac{3}{4}$ of the length of said main body.

6. Muffler comprising an essentially cylindrical main body, a front end plate and a back end plate on the ends of said main body, an inlet pipe leading through said front end plate, an outlet pipe leading through said back end plate, said inlet pipe having an end portion within said main body, and a continuous porous member of a heat-resistant material at and within said end of said inlet pipe, said porous member being internally formed with circuitous gas flow paths therethrough.

7. Muffler according to claim 6, characterized in that said continuous porous member is of one of metal sponge, metallic wool mat, multi-layer wire netting in pile form.

8. Muffler according to claim 6, wherein said inlet pipe has annular constricted portions formed proximate the end portion thereof between which said porous member is held.

9. Muffler according to claim 8, wherein one of said constricted portions is a flange portion formed on the end portion of said inlet pipe.

10. Muffler comprising a sealed cylindrical main body, an inlet pipe and an outlet pipe leading, respectively, into and out of said main body, said inlet pipe having an end portion within said main body, at least one porous partition dividing the interior of said main body into at least a front chamber and a rear chamber, said inlet pipe and said outlet pipe being supported by said partition wall, a heat-resistant continuous porous member capping said end portion of said inlet pipe, the wall of at least one of that part of said inlet pipe within said front chamber and that part of said outlet pipe within said rear chamber being provided with short-circuit holes for providing flow of exhaust gas in addition to that traversing said porous portion.

11. Muffler according to claim 10, wherein the relation between the length $a$ of said inlet pipe and the length $b$ of said outlet pipe to that of said main body is one of the following:

$$a = \tfrac{1}{4}L \text{ and } b = \tfrac{3}{4}L;\ a = \tfrac{3}{4}L \text{ and } b = \tfrac{1}{4}L$$

where, L is the length of the main body.

12. Muffler according to claim 10, wherein the diameter $\phi$ and number of said short-circuit holes in the wall of one of said inlet pipe and said outlet pipe is in the range of $1/20\ D \times 4$ to $3/20\ D \times 2$ with respect to the pipe diameter D of said inlet pipe or of said outlet pipe.

13. Muffler according to claim 10, wherein said short-circuit holes are provided on the inlet pipe and its tip is of reduced diameter relative to the remainder of said inlet pipe.

14. Muffler according to claim 10, wherein said main body contains two porous partition walls dividing same into three chambers termed front, middle and rear, said inlet pipe and said outlet pipe communicating respectively with said rear chamber and said front chamber, and said short-circuit holes being provided on the outlet pipe within said rear chamber.

15. Muffler according to claim 14, further including an exhaust pipe leading into and connected with said inlet pipe, and wherein the diameter of said inlet pipe is smaller than that of said exhaust pipe.

16. Muffler according to claim 10, wherein said heat-resistant continuous porous member is of foam metal.

17. Muffler according to claim 16, wherein said foam metal is in dish-shape.

18. A muffler, comprising a sealed, essentially-cylindrical main body, an exhaust gas inlet pipe, an exhaust gas outlet pipe, a portion of each of said pipes being disposed within said sealed cylindrical main body, the end of said portion of said exhaust gas inlet pipe within said main body being constricted and open, and a cap member of a foam metal covering said open end.

19. Muffler according to claim 18, comprising a porous partition dividing the interior of said sealed cylindrical main body into a front and a rear chamber, and wherein said exhaust gas inlet pipe extends into said rear chamber through said partition, and said exhaust gas outlet pipe communicates with said front chamber through said partition.

20. Muffler according to claim 19, wherein short-circuit holes are provided on that portion of said exhaust gas inlet pipe in said main body.

21. Muffler according to claim 18, wherein said cap member is of metallic fiber.

22. Muffler according to claim 1, wherein said downstream end of said inlet pipe is constricted to an inside diameter D for forming a jet in exhaust gas flowing therethrough, and, further comprising a barrier for impingement of said jet thereagainst, said barrier being positioned at a distance of at least 5D from said open end.

23. Muffler according to claim 18, further comprising a porous partition dividing said main body into a front and a rear chamber, said inlet pipe entering into and communicating with said rear chamber and said outlet pipe communicating with said front chamber, and wherein said inlet pipe has short-circuit holes in that part of the wall thereof within said rear chamber for by-passing a portion of the gas flowing through said inlet pipe into said rear chamber without passing through said cap member.

* * * * *